US009213229B2

(12) United States Patent
Iwashita et al.

(10) Patent No.: US 9,213,229 B2
(45) Date of Patent: Dec. 15, 2015

(54) POSITIVELY CHARGEABLE ELECTROPHOTOGRAPHIC PHOTOSENSITIVE MEMBER AND IMAGE FORMING APPARATUS

(71) Applicant: KYOCERA DOCUMENT SOLUTIONS INC., Osaka (JP)

(72) Inventors: Yuko Iwashita, Osaka (JP); Yukimasa Watanabe, Osaka (JP); Junichiro Otsubo, Osaka (JP); Kazuaki Ezure, Osaka (JP); Kazutaka Sugimoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 24 days.

(21) Appl. No.: 14/169,031

(22) Filed: Jan. 30, 2014

(65) Prior Publication Data

US 2014/0212803 A1 Jul. 31, 2014

(30) Foreign Application Priority Data

Jan. 30, 2013 (JP) ..... 2013-016083

(51) Int. Cl.

| | |
|---|---|
| ***G03G 5/08*** | (2006.01) |
| ***G03C 1/73*** | (2006.01) |
| ***G03C 1/52*** | (2006.01) |
| ***G03G 5/047*** | (2006.01) |
| ***G03G 5/05*** | (2006.01) |

(52) U.S. Cl.

CPC .. *G03C 1/73* (2013.01); *G03C 1/52* (2013.01); *G03G 5/047* (2013.01); *G03G 5/0542* (2013.01)

(58) Field of Classification Search

CPC ..... G03G 5/04; G03G 5/047; G03G 5/0528; G03G 5/0532; G03G 5/0542

See application file for complete search history.

(56) References Cited

U.S. PATENT DOCUMENTS

2009/0325094 A1* 12/2009 Tong et al. ..... 430/58.8

FOREIGN PATENT DOCUMENTS

| | | | |
|---|---|---|---|
| JP | 64-040834 | A | 2/1989 |
| JP | H01-159665 | A | 6/1989 |
| JP | H07-319178 | A | 12/1995 |
| JP | 2003-228182 | A | 8/2003 |

OTHER PUBLICATIONS

An Office Action, "Notice of Reasons for Rejection," issued by the Japanese Patent Office on Feb. 3, 2015, which corresponds to Japanese Patent Application No. 2013-016083 and is related to U.S. Appl. No. 14/169,031.

* cited by examiner

*Primary Examiner* — Peter Vajda

(74) *Attorney, Agent, or Firm* — Studebaker & Brackett PC

(57) ABSTRACT

A positively chargeable electrophotographic photosensitive member has a photosensitive layer. The photosensitive layer at least includes the following layers layered in the stated order: (I) a charge transport layer at least containing a hole transport material and a binder resin; and (II) a charge generating-and-transporting layer at least containing a charge generating material, an electron transport material, a hole transport material, and a binder resin all within this layer. The binder resin contained in the charge transport layer is different from the binder resin contained in the charge generating-and-transporting layer, and either of the binder resins contains a polyvinyl acetal resin.

11 Claims, 2 Drawing Sheets

POSITIVELY CHARGEABLE ELECTROPHOTOGRAPHIC PHOTOSENSITIVE MEMBER AND IMAGE FORMING APPARATUS

INCORPORATION BY REFERENCE

The present application claims priority under 35 U.S.C. §119 to Japanese Patent Application No. 2013-016083, filed Jan. 30, 2013. The contents of this application are incorporated herein by reference in their entirety.

BACKGROUND

The present disclosure relates to a positively chargeable electrophotographic photosensitive member and an image forming apparatus using the same.

An electrophotographic image forming apparatus includes an electrophotographic photosensitive member. Examples of electrophotographic photosensitive members include inorganic photosensitive members and organic photosensitive members. An inorganic photosensitive member includes a photosensitive layer containing an inorganic material such as selenium or amorphous silicon. An organic photosensitive member includes a photosensitive layer mainly containing an organic material such as a binder resin, a charge generating material, and a charge transport material. Organic photosensitive members are widely used for the following reason. That is, organic photosensitive members can be produced more easily than inorganic photosensitive members and allow materials for the photosensitive layer to be selected from a wide variety of materials, providing high design flexibility.

Examples of such photosensitive members include negatively chargeable photosensitive members and positively chargeable photosensitive members. As compared with the positively chargeable photosensitive members, the negatively chargeable photosensitive members are problematic in that corona discharge utilized at the time of charging may be instable and that ozone, nitrogen oxide, and the like may be generated and adhere to the surface of the photosensitive members, which tends to result in physical and chemical degradation, or environmental degradation. From these standpoints, positively chargeable photosensitive members are more advantageous than negatively chargeable photosensitive members because of its greater flexibility in the conditions of use and its wider application range.

As such a positively chargeable photosensitive member, suggestion is made to use a positively chargeable multi-layered electrophotographic photosensitive member in which, for example, a charge generating layer is disposed on a charge transport layer. This layer structure is in reverse of a typical negatively chargeable multi-layered electrophotographic photosensitive member. However, the charge transport layer needs to contain as a charge transport material a hole transport material, which has excellent charge transport capability. In this case, the charge generating layer is disposed to form a top surface of the positively chargeable multi-layered electrophotographic photosensitive member. As a result, the charge generating layer may abrade to cause a significant change in its characteristics, which may lead to a problem that a sufficient durability is failed to be ensured.

A positively chargeable single-layer electrophotographic photosensitive member includes a photosensitive layer containing both an electron transport material and a hole transport material as the charge transport material. Thus, the photosensitive member has sensitivity to both the positive and negative charges. For this reason, single-layer electrophotographic photosensitive members are currently in the mainstream of electrophotographic photosensitive members of a positively chargeable type.

SUMMARY

A first aspect of the present disclosure relates to a positively chargeable electrophotographic photosensitive member.

The positively chargeable electrophotographic photosensitive member at least includes, layered in the stated order: (I) a charge transport layer at least containing a hole transport material and a binder resin; and (II) a charge generating-and-transporting layer at least containing a charge generating material, an electron transport material, a hole transport material, and a binder resin all within this layer. The binder resin contained in the charge transport layer is different from the binder resin contained in the charge generating-and-transporting layer, and either of the binder resins contains a polyvinyl acetal resin.

An image forming apparatus according to a second aspect of the present disclosure includes: an image bearing member; a charger configured to charge a surface of the image bearing member; an exposure section configured to expose the charged surface of the image bearing member to light, thereby to form an electrostatic latent image thereon; a developing section configured to develop the electrostatic latent image into a toner image; and a transfer section configured to transfer the toner image from the image bearing member to a transfer target. The image bearing member is a positively chargeable electrophotographic photosensitive member according to the first aspect.

DETAILED DESCRIPTION

Figure 1A:
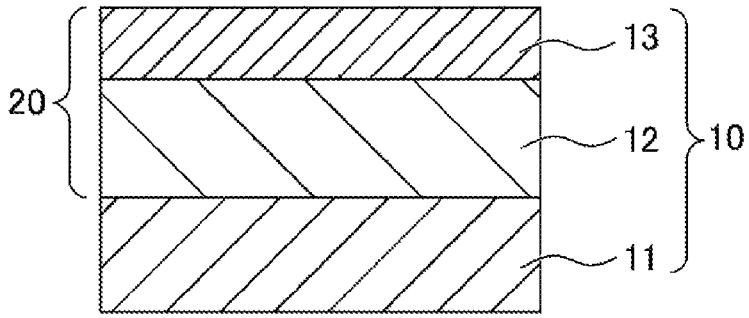
FIGS. 1A-1D show a structure of an electrophotographic photosensitive member according to a first embodiment.

The following describes embodiments of the present disclosure in detail. The present disclosure is in no way limited to the embodiments below, and modifications may be appropriately made within the scope of the aim of the present disclosure. Note that some overlapping explanations may be appropriately omitted, but such omission is not intended to limit the gist of the disclosure.

First Embodiment

A first embodiment of the present disclosure relates to a positively chargeable electrophotographic photosensitive member. The positively chargeable electrophotographic photosensitive member includes photosensitive layers (multi-layered photosensitive layer) at least including, layered in the stated order: (I) a charge transport layer at least containing a hole transport material and a binder resin; and (II) a charge generating-and-transporting layer at least containing a charge generating material, an electron transport material, a hole transport material, and a binder resin all within this layer. The multi-layered photosensitive layer is disposed on a conductive substrate. The binder resin contained in the charge transport layer is different from the binder resin contained in the generating-and-transporting layer. Either of the binder resins contains a polyvinyl acetal resin.

With reference to FIGS. 1A-1D, the following describes the positively chargeable electrophotographic photosensitive member according to the first embodiment of the present disclosure. A positively chargeable electrophotographic photosensitive member 10 (hereinafter, may also be referred to as "two-layer positively chargeable electrophotographic photosensitive member", "two-layer positively chargeable photosensitive member", or "two-layer photosensitive member") shown in FIG. 1A includes a multi-layered photosensitive layer 20. To manufacture the multi-layered photosensitive layer 20, a charge transport layer 12 at least containing a hole transport material and a binder resin is formed on a conductive substrate 11 by means of application, for example. Subsequently, a charge generating-and-transporting layer 13 at least containing a charge generating material, an electron transport material, a hole transport material, and a binder resin is formed on the charge transport layer 12.

Figure 1B:
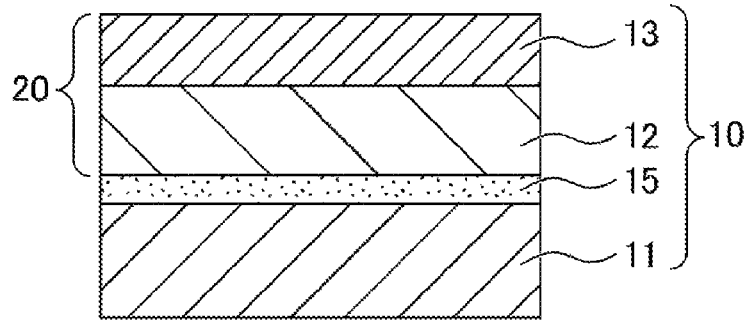

It is also preferable to form an undercoat layer 15 on the conductive substrate 11 prior to the formation of the multi-layered photosensitive layer 20, as in the positively chargeable electrophotographic photosensitive member 10 shown in FIG. 1B. Providing the undercoat layer 15 can prevent injection of charges into the photosensitive layer 20 from the side of the conductive substrate 11. In addition, providing the undercoat layer 15 can strengthen the binding of the photosensitive layer 20 to the conductive substrate 11, and cover defects in the surface of the conductive substrate 11 to smooth the surface.

With respect to the positively chargeable electrophotographic photosensitive member according to the first embodiment of the present disclosure, the following sequentially describes the conductive substrate, the charge transport layer, the charge generating-and-transporting layer, and a method for manufacturing the multi-layered photosensitive layer.

[Conductive Substrate]

The conductive substrate is not specifically limited as long as it is usable as a conductive substrate of the electrophotographic photosensitive member. Specific examples include one at least a surface portion of which is made of a conductive material. Specifically, the conductive substrate may be one made from a conductive material or one made from a plastic material or the like having a surface coated with a conductive material. Examples of conductive materials include aluminum, iron, copper, tin, platinum, silver, vanadium, molybdenum, chromium, cadmium, titanium, nickel, palladium, indium, stainless steel, and brass. Further, a single conductive material may be used as the conductive material. Alternatively, two or more conductive materials may be combined and used as an alloy, for example. Preferably, the conductive substrate is made from aluminum or aluminum alloy from among the materials mentioned above. The use of a conductive substrate made from aluminum or aluminum alloy can provide the photosensitive member capable of forming more appropriate images. It is likely to be because of charges move well from the multi-layered photosensitive layer to the conductive substrate.

The shape of the conductive substrate can be appropriately selected depending on the configuration of the image forming apparatus used. As the conductive substrate, a substrate of any shape, including a sheet, drum, and the like, can be suitably used. The thickness of the conductive substrate can be appropriately selected depending on the shape of the substrate.

[Charge Transport Layer]

The charge transport layer at least contains a hole transport material (HTM) and a binder resin. The hole transport material used here is not specifically limited, and any hole transport material contained in the photosensitive layer of a typical electrophotographic photosensitive member is usable. Specific examples of the hole transport material include a benzidine derivative, an oxadiazole based compound (e.g., 2,5-di(4-methylaminophenyl)-1,3,4-oxadiazole), a styryl based compound (e.g., 9-(4-diethylaminostyryl)anthracene), a carbazole based compound (e.g., polyvinyl carbazole), an organic polysilane compound, a pyrazoline based compound (e.g., 1-phenyl-3-(p-dimethylaminophenyl)pyrazoline), a nitrogen containing cyclic compound, and a condensed polycyclic compound (e.g., a hydrazone based compound, a triphenyl amine based compound, an indole based compound, an oxazole based compound, an isoxazole based compound, a thiazole based compound, and a triazole based compound). Among these hole transport materials, more preferable is a triphenyl amine based compound having one or multiple triphenyl amine backbone in one molecule. These hole transport materials may be used alone, or two or more of the hole transport materials may be used in combination.

The binder resin is not specifically limited as long as it is usable as the binder resin contained in the photosensitive layer of the photosensitive member. Specific examples of resins suitable for use as the binder resin include: thermoplastic resins, such as a polycarbonate resin, a styrene based resin, a styrene-butadiene copolymer, a styrene-acrylonitrile copolymer, a styrene-maleic acid copolymer, a styrene-acrylic acid copolymer, an acrylic copolymer, a polyethylene resin, an ethylene-vinyl acetate copolymer, a chlorinated polyethylene resin, a polyvinyl chloride resin, a polypropylene resin, an ionomer, a vinyl chloride-vinyl acetate copolymer, an alkyd resin, a polyamide resin, a polyurethane resin, a polyarylate resin, a polysulfone resin, a diallyl phthalate resin, a ketone resin, a polyvinyl formal resin, a polyvinyl butyral resin, a polyether resin, and a polyester resin; thermosetting resins, such as a silicone resin, an epoxy resin, a phenol resin, a urea resin, a melamine resin, and other crosslinkable thermosetting resins; and photocurable resins, such as an epoxy acrylate resin and a urethane-acrylate copolymer resin. These resins may be used alone or two or more of the resins may be used in combination.

From among these resins, polycarbonate resins, such as a bisphenol Z polycarbonate resin, a bisphenol ZC polycarbonate resin, a bisphenol C polycarbonate resin, and a bisphenol A polycarbonate resin, are more preferable because these resins allow the resulting photosensitive layer to have an excellent balance between workability, mechanical properties, optical properties, and abrasion resistance.

The content of the hole transport material in the charge transport layer of the present disclosure is appropriately determined and not specifically limited. Specifically, the content of the hole transport material is preferably from 15% to 150% by mass with respect to the binder resin, and more preferably from 30% to 100% by mass.

The thickness of the charge transport layer is preferably from 1 μm to 40 μm. The charge transport layer is formed by means of application to have a thickness of 1 μm or more, so that the thickness of the charge transport layer is ensured to be uniform. On the other hand, ensuring the charge transport layer to have a thickness of 40 μm or less is effective to prevent reduction of mechanical strength. The thickness of the charge transport layer is preferably from 5 μm to 35 μm.

[Charge Transport Layer]

The charge generating-and-transporting layer is disposed on the charge transport layer and at least contains a charge generating material (CGM), an electron transport material (ETM), a hole transport material (HTM), and a binder resin all within the charge generating-and-transporting layer. The charge generating material, the electron transport material, the hole transport material, and the binder resin used herein are not specifically limited, and any material conventionally used to prepare a photosensitive layer of an electrophotographic photosensitive member may be used.

For the hole transport material (HTM) and the binder resin used to prepare the charge generating-and-transporting layer, the same materials as those mentioned above in the description of the charge transport layer may be used.

Specific examples of the electron transport material (ETM) used in the charge generating-and-transporting layer include: quinone derivatives, such as a naphthoquinone derivative, a diphenoquinone derivative, an anthraquinone derivative, an azoquinone derivative, a nitroanthraquinone derivative, and a dinitroanthraquinone derivative; a malononitrile derivative; a thiopyrane derivative; a trinitrothioxanthone derivative; a 3,4,5,7-tetranitro-9-fluorenone derivative; a dinitroanthracene derivative; a dinitroacridine derivative; tetracyanoethylene; 2,4,8-trinitrothioxanthone; dinitrobenzene; dinitroanthracene; dinitroacridine; succinic anhydride; maleic anhydride; and dibromomaleic anhydride. These electron transport materials may be used alone, or two or more of the electron transport materials may be used in combination.

Specific examples of the charge generating material (CGM) include: X-form metal-free phthalocyanine (x-$H_2$Pc) represented by the chemical formula (1) below: Y-form titanyl phthalocyanine (Y—TiOPc); a dithioketopyrrolopyrrole pigment; a metal-free naphthalocyanine pigment; a metal naphthalocyanine pigment; a squaraine pigment; an indigo pigment; an azulenium pigment; a cyanine pigment; powder of inorganic photoconductive materials, such as selenium, selenium-tellurium, selenium-arsenic, cadmium sulfide, and amorphous silicon; a pyrylium salt; an anthanthrone based pigment; a triphenylmethane based pigment; a threne based pigment; a toluidine based pigment; a pyrazoline based pigment; and a quinacridone based pigment.

Chemical Formula (1)

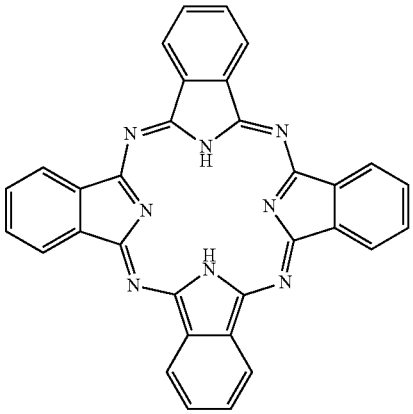

Of these charge generating materials mentioned above, Y-form titanyl phthalocyanine (Y—TiOPc) or titanyl phthalocyanine is preferable for improving the sensitivity. Especially preferable is one satisfying both of the following: (A) in CuKα characteristic X-ray diffraction, a main peak is observed at a Bragg angle of 2θ±0.2°=27.2°; and (B) in differential scanning calorimetry, a single peak is observed within a range of 270° C. to 400° C. except for the peak caused by vaporization of absorbed water.

Then, a charge generating material having an absorption wavelength within a defined range may be used alone, or two or more such charge generating materials may be used in combination. Further, from among these charge generating materials mentioned above, use of a photosensitive member having sensitivity in a wavelength range of 700 nm or longer is preferable for an image forming apparatus employing a digital optical system (e.g., laser beam printers or fax machines including a semiconductor laser as the light source). As the charge generating material, a phthalocyanine based pigment (e.g., metal-free phthalocyanine or titanyl phthalocyanine) is appropriately used. The crystal form of the phthalocyanine based pigment is not specifically limited, and the various crystal forms are applicable.

The respective contents of the charge generating material (CGM), the electron transport material (ETM), the hole transport material (HTM), and the binder resin in the charge generating-and-transporting layer are appropriately selected and not specifically limited. Specifically, for example, the content of the charge generating material is preferably from 1% by mass to 20% by mass with respect to the binder resin, and more preferably from 2% by mass to 10% by mass. The content of the electron transport material (ETM) is preferably from 15% by mass to 120% by mass with respect to the binder resin, and more preferably from 30% by mass to 100% by mass. The content of the hole transport material (HTM) is preferably from 15% by mass to 120% by mass with respect to the binder resin, and more preferably from 20% by mass to 90% by mass. Ensuring the amount of use of each material within the range specified above is effective to reduce the potential difference in absolute value measured on the positively charged photosensitive member under the conditions according to the present disclosure, which reduces occurrence of transfer memory.

The thickness of the charge generating-and-transporting layer is preferably from 1 μm to 20 μm. With the thickness of 1 μm or more, the charge generating-and-transporting layer is ensured to have a uniform thickness. With the thickness of 20 μm or less, the charge generating-and-transporting layer can prevent reduction of mechanical strength. Therefore, the thickness of the generating-and-transporting layer is more preferably from 3 μm to 15 μm.

(Method for Manufacturing Positively Chargeable Electrophotographic Photosensitive Member)

The method for manufacturing the positively chargeable electrophotographic photosensitive member according to the present disclosure is not specifically limited as long as the aim of the present disclosure is not obstructed. Preferable examples include a method for forming a photosensitive layer by applying an application liquid for the photosensitive layer on a conductive substrate.

Specifically, the charge transport material and the binder resin, along with optional additives and the like as needed, are dissolved or dispersed in a solvent to prepare an application liquid. The application liquid is then applied to a conductive substrate, followed by drying, to produce a charge transport layer. The method for applying the application liquid is not specifically limited, and examples include a method using a spin coater, an applicator, a spray coater, a bar coater, a dip coater, or a doctor blade. Preferable among these application methods is an immersion method using a dip coater because this method allows continuous production and ensures excellent economic efficiency. Examples of a method for drying the applied film on the conductive substrate include hot-air drying at a temperature from 80° to 150° C. and for a time period of from 15 minutes to 120 minutes.

Subsequently, the charge generating material, the charge transport material, and the binder resin which is different from the one contained in the charge transport layer are dissolved or dispersed along with various optional additives and the like as needed. As a result, an application liquid is obtained. Then, the thus obtained application liquid is applied on the charge transport layer formed on the conductive substrate as described above, followed by drying in the same manner as described above. As a result, the charge generating-and-transporting layer is formed.

For forming the charge transport layer and the charge generating-and-transporting layer, both of the following need to be satisfied: mutually different binder resins need to be used to form the respective layers; and the application liquid used for forming either of the layers needs to contain a polyvinyl acetal resin as the binder resin. In the case where the same binder resin is contained in the charge transport layer and the charge generating-and-transporting layer, the application liquids for the respective layers applied on one another may be compatible at the time of layering the charge transport layer and the charge generating-and-transporting layer. This may result in various adverse effects, typically on the sensitivity of the photosensitive member. As described above, undesirable possibilities are associated with successive applications of the respective application liquids for forming the multi-layered photosensitive layer. However, such possibilities can avoided by ensuring that the binder resin contained in one of the charge transport layer and the charge generating-and-transporting layer is a polyvinyl acetal resin and the binder resin contained in the other layer is a resin other than a polyvinyl acetal resin.

The polyvinyl acetal resin employed in the present disclosure is an acetal resin synthesized by acetalization reaction of polyvinyl alcohol and an aldehyde. Examples include a polyvinyl formal resin and a polyvinyl butyral resin. The molecular weight or the degree of acetalization of the polyvinyl acetal resin is not specifically limited. Preferably, the viscosity-average molecular weight of the polyvinyl acetal resin is from 10000 to 200000. Preferably, the degree of acetalization of the polyvinyl acetal resin is from 60% by mol to 80% by mol. The molecular weight and the degree of acetalization of the polyvinyl acetal resin are each selected to be within an optimum range in consideration of various factors, including the compatibility with any other binder resin additionally used, with the charge generating material, with the charge transport material, or with other additives and the solubility in an organic solvent.

The solvent contained in the application liquid for the photosensitive layer is not specifically limited as long as the respective components of the photosensitive layer can be duly dissolved or dispersed. Specific examples of the solvent includes: alcohols, such as methanol, ethanol, isopropanol, and butanol; aliphatic hydrocarbons, such as n-hexane, octane, and cyclohexane; aromatic hydrocarbons, such as benzene, toluene, and xylene; halogenized hydrocarbons, such as dichloromethane, dichloroethane, carbon tetrachloride, and chlorobenzene; ethers, such as dimethylether, diethylether, tetrahydrofuran, ethylene glycol dimethylether, and diethylene glycol dimethylether; ketones, such as acetone, methylethylketone, methylisobutylketone, and cyclohexanone; esters, such as ethyl acetate and methyl acetate; and aprotic polar organic solvents, such as dimethyl formaldehyde, dimethyl formamide, and dimethyl sulfoxide. These solvents may be used alone, or two or more of the solvents may be used in combination.

In addition to the charge generating material, the hole transport material, the electron transport material, and the binder resin described above, the charge transport layer and/or the charge generating-and-transporting layer may contain various additives within a range not adversely affecting the electrophotographic characteristics. Examples of additives which may be contained in the photosensitive layer include antidegradants (e.g., an antioxidant, a radical scavenger, a singlet quencher, and an ultraviolet absorbing agent), softeners, plasticizers, polycyclic aromatic compounds, surface modifiers, bulking agents, thickeners, dispersion stabilizers, waxes, oils, acceptors, donors, surfactants, and leveling agents.

Further, the charge transport layer in the positively chargeable electrophotographic photosensitive member has a multi-layered structure that includes: a first charge transport layer at least containing the hole transport material and a binder resin; and a second charge transport layer at least containing the hole transport material and a binder resin (it is a three-layer positively chargeable electrophotographic photosensitive member). Here, it is required that the binder resin in the second charge transport layer contains a polyvinyl acetal resin and that neither the binder resin in the first charge transport layer nor the binder resin in the charge generating-and-transporting layer contains a polyvinyl acetal resin.

Figure 1C:
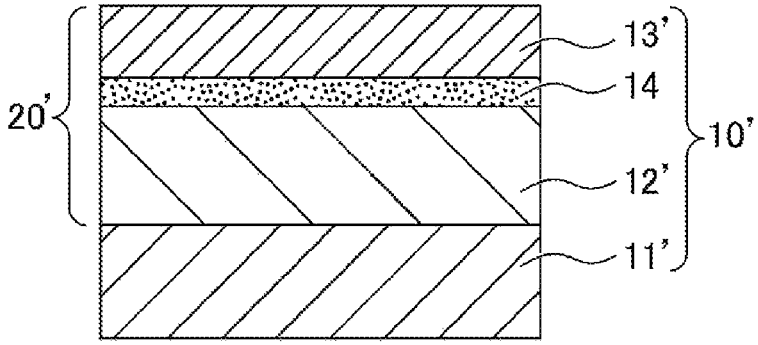
Figure 1D:
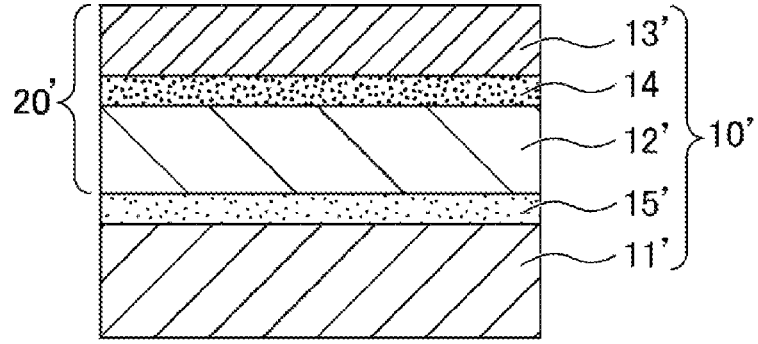

With reference to FIGS. 1C-1D, the following describes the positively chargeable electrophotographic photosensitive member according to the present disclosure. As in a positively chargeable electrophotographic photosensitive member 10' shown in FIG. 1C, a first charge transport layer 12' is formed on a conductive substrate 11' by means of application, for example. Next, a second charge transport layer 14 is formed on the first charge transport layer 12'. Further, a charge generating-and-transporting layer 13' is formed on the second charge transport layer 14 to produce the positively chargeable electrophotographic photosensitive member 10' including a multi-layered photosensitive layer 20'. Preferably, the second charge transport layer 14 is formed to be thinner than the first charge transport layer 12'. It is also preferable that the positively chargeable electrophotographic photosensitive member 10' includes an undercoat layer 15' between the conductive substrate 11' and the first charge transport layer 12' as in the positively chargeable electrophotographic photosensitive member 10' shown in FIG. 1D.

The details of the conductive substrate and the charge generating-and-transporting layer included in the three-layer positively chargeable electrophotographic photosensitive member are the same as those of the conductive substrate and the charge generating-and-transporting layer included in the two-layer positively chargeable electrophotographic photosensitive member. The details of the first charge transport layer included in the three-layer positively chargeable electrophotographic photosensitive member are the same as those of the charge transport layer included in the two-layer positively chargeable electrophotographic photosensitive member. Yet, neither the first charge transport layer nor the charge generating-and-transporting layer contains a polyvinyl acetal resin as the binder resin. The following now describes the second charge transport layer.

[Second Charge Transport Layer]

The second charge transport layer at least contains a hole transport material (HTM) and a binder resin. The hole transport material used here is not specifically limited, and any hole transport material contained in the photosensitive layer of a conventional electrophotographic photosensitive member is usable.

As the binder resin, the same polyvinyl acetal resin as described above needs to be contained. On the other hand, neither the first charge transport layer nor the charge generating-and-transporting layer contains a polyvinyl acetal resin as the binder resin. With the multi-layered photosensitive layer having such a structure, the three-layer positively chargeable electrophotographic photosensitive member can avoid problems of impairing various characteristics, typically the sensitivity of the photosensitive member, resulting from the compatibility of the respective layers of the multi-layered photosensitive layer. Further, in this case, a sufficient image density can be achieved by both a machine with a small exposure amount (such as LED) and a high-speed machine.

The second charge transport layer may contain a binder resin different from a polyvinyl acetal resin. The different binder resin is not specifically limited, and any of the binder resins listed as examples for the two-layer positively chargeable electrophotographic photosensitive member is usable as long as it can be contained in the photosensitive layer of an electrophotographic photosensitive member.

The content of the hole transport material in the second charge transport layer of the present disclosure is appropriately determined and not specifically limited. Specifically, the content of the hole transport material is preferably from 5% by mass to 150% by mass with respect to the binder resin, and more preferably from 30% by mass to 100% by mass.

Preferably, the second charge transport layer is thinner than the first charge transport layer. With the first charge transport layer and the second charge transport layer each formed to have a thickness satisfying the above, the resulting positively chargeable electrophotographic photosensitive member is likely to achieve excellent sensitivity. The thickness of the second charge transport layer is preferably from 0.5 μm to 5 μm. With the thickness of the charge transport layer being 0.5 μm or more, the charge transport layer is ensured to have a uniform thickness. On the other hand, with the thickness of the second charge transport layer being 5 μm or less and the thickness of the first charge transport layer being from 5 μm to 35 μm, the first charge transport layer is ensured to have high charge mobility and a sufficient thickness, while improving charge injection from the charge generating-and-transporting layer to the second charge transport layer.

Second Embodiment

A second embodiment of the present disclosure is directed to an image forming apparatus. The image forming apparatus according to the present embodiment includes an image bearing member, a charger for charging the surface of the image bearing member, an exposure section for exposing the surface of the image bearing member with light so as to form an electrostatic latent image thereon, and a developing section for developing the electrostatic latent image into a toner image, and a transfer section for transferring the toner image onto a transfer target. The image bearing member is the positively chargeable electrophotographic photosensitive member (it is a two- or three-layer positively chargeable electrophotographic photosensitive member) according to the first embodiment.

Of the image forming apparatus according to the present disclosure, components other than the image bearing member such as the charger, the exposure section, the developing section, and the transfer section are those used in a well-known image forming apparatus are adopted without specific limitations. Especially preferable is a monochrome image forming apparatus or a tandem color image forming apparatus using multiple color toners as described below. The following description is directed to a tandem color image forming apparatus.

The tandem color image forming apparatus having the positively chargeable electrophotographic photosensitive member according to the present embodiment includes a plurality of image bearing members and a plurality of developing sections. The image bearing members are disposed in parallel to one another in a predetermined direction so as to form toner images of different colors on their respective surfaces. Each of the developing sections is disposed to face a corresponding one of the image bearing members and includes a developing roller. Each developing roller holds toner on its surface to carry the toner to supply it to the surface of the corresponding image bearing member. In the present disclosure, each image bearing member is the positively chargeable electrophotographic photosensitive member according to the first embodiment.

Figure 2:
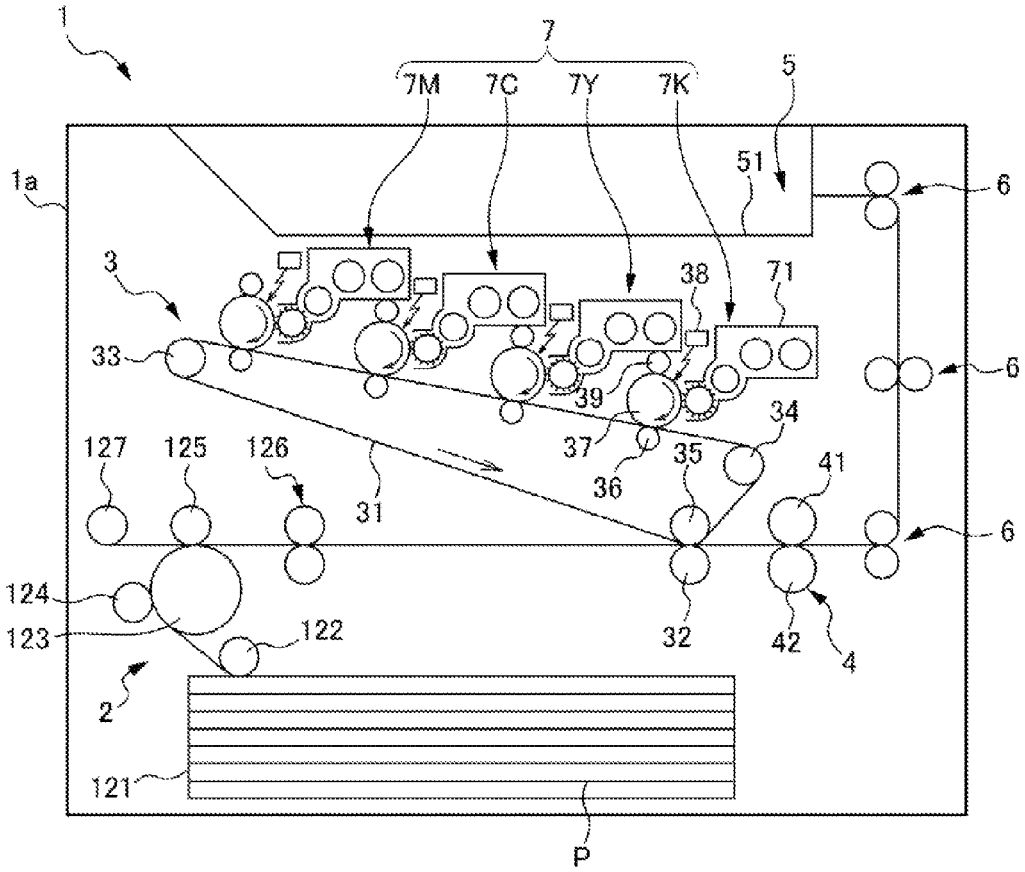
FIG. 2 is a schematic view showing a structure of an image forming apparatus including the electrophotographic photosensitive member according to the first embodiment.

FIG. 2 is a schematic view showing a structure of the image forming apparatus including the positively chargeable electrophotographic photosensitive member according to the present disclosure. In this embodiment, a color printer 1 is described as an example of the image forming apparatus.

The color printer 1 includes a boxlike main body 1*a* as shown in FIG. 2. Disposed in the main body 1*a* are a paper feeder 2, an image forming section 3, and a fixing section 4. The paper feeder 2 feeds paper P. While conveying the paper P fed from the paper feeder 2, the image forming section 3 transfers a toner image formed according to image data to the paper P. The fixing section 4 performs a fixing process so that an unfixed toner image transferred to the paper P by the image forming section 3 is fixed. Further, a paper ejecting section 5 is disposed on the upper surface of the main body 1*a*. The paper P having gone through the fixing process by the fixing section 4 is ejected from the paper ejecting section 5.

The paper feeder 2 includes a paper feed cassette 121, a pickup roller 122, paper feed rollers 123, 124 and 125, and a registration roller 126. The paper feed cassette 121 is disposed to be removable from the main body 1*a*. The paper feed cassette 121 stores paper P of the respective sizes. In FIG. 2, the pickup roller 122 is disposed at an upper left position of the paper feed cassette 121. The pickup roller 122 picks up the paper P stored in the paper feed cassette 121 sheet by sheet. The paper feed rollers 123, 124, and 125 forward the paper P picked up by the pickup roller 122 to a paper conveyance path. The registration roller 126 temporarily places on standby the paper P forwarded to the paper conveying path by paper feed rollers 123, 124, and 125. Subsequently, the registration roller 126 feeds the paper P to the image forming section 3 with appropriately adjusted timing.

The paper feeder 2 further includes a manual feed tray (not shown), which is to be attached at the left side of the main body 1*a*, and a pickup roller 127. The pickup roller 127 picks up the paper P placed in the manual feed tray. The paper P picked up by the pickup roller 127 is forwarded to the paper conveyance path by the paper feed rollers 123 and 125 and then fed to the image forming section 3 by the registration roller 126 with appropriately adjusted timing.

The image forming section 3 includes an image forming unit 7, an intermediate transfer belt 31, and a secondary transfer roller 32. The image forming unit 7 carries out primary transfer so that a toner image, which is formed based on the image data transmitted from a computer, is transferred onto the surface of the intermediate transfer belt 31 contacted with the surface of the secondary transfer roller 32. Second transfer is carried out by using the secondary transfer roller 32 so that the toner image on the intermediate transfer belt 31 is transferred to the paper P fed from the paper feed cassette 121.

The image forming unit 7 includes a unit for black ink 7K, a unit for yellow ink 7Y, a unit for cyan ink 7C, and a unit for magenta ink 7M disposed in the stated order from the upstream side (right side in the figure) to the downstream side. The respective units 7K, 7Y, 7C, and 7M each include, as an image bearing member, a positively chargeable electrophotographic photosensitive member 37 (hereinafter, photosensitive member 37) centrally disposed to be rotatable in the arrowed direction (clockwise). Each photosensitive member 37 is surrounded by a charger 39, an exposure section 38, a developing section 71, a cleaner section (not shown), and a static eliminator (not shown) acting as a static eliminating section, and the like that are disposed in the stated order from the upstream side in the rotation direction. According to the present disclosure, the image forming apparatus can appropriately form images without a static elimination step performed by a static eliminator, which allows for space-saving.

Each charger 39 uniformly charges the peripheral surface of the corresponding photosensitive member 37 rotating in the direction indicated by the arrow. The charger 39 is not specifically limited as long as the peripheral surface of the photosensitive member 37 can be uniformly charged, and may be of a non-contact type or contact type. Specific examples of the charger include a corona charging device, a charging roller, and a charging brush. Of these examples, a contact type charging device, such as a charging roller or a charging brush, is more preferable. Use of a contact type charging device as the charger 39 is effective to suppress emission of active gases such as ozone or nitrogen oxides generated by the charger 39. This is effective to prevent degradation of the photosensitive layer of the photosensitive member due to the active gases, and also to provide a design contributing to a better office environment, for example.

The charger 39 including a contact type charging roller stays in contact, at the charging roller, with the photosensitive member 37 and charges the periphery surface of the photosensitive member 37. One example of such a charging roller is a roller that is driven to rotate by following rotation of the photosensitive member 37 while remaining in contact with the photosensitive member 37. Further, in one example of a charging roller, at least a surface portion of the roller is formed of a resin. More specifically, the charging roller may have, for example a cored bar supported axially rotatably, a resin layer formed to coat the cored bar, and a voltage application section for applying voltage to the cored bar. The charger that includes such a charging roller can apply voltage to the cored bar by the voltage application section to charge the surface of the photosensitive member 37 that is in contact with the charging roller via the resin layer.

Preferably, the voltage applied by the voltage application section to the charging roller is direct voltage only. The direct voltage applied by the charging roller to the electrophotographic photosensitive member is preferably from 1000 V to 2000 V, and more preferably from 1200 V to 1800 V, and particularly preferably from 1400 V to 1600V. As compared with application of alternating voltage or superimposed voltage in which direct voltage and alternating voltage are superimposed to the charging roller, application of only direct voltage to the charging roller is effective to reduce the abrasion amount of the multi-layered photosensitive layer.

The resin which is a component of the resin layer of the charging roller is not specifically limited as long as the resin allows the peripheral surface of the photosensitive member 37 to be duly charged. Specific examples of the resin used for the resin layer include a silicone resin, a urethane resin, and a silicone modified resin. In addition, the resin layer may contain inorganic filler.

The exposure section 38 is so-called a laser scanning unit. The exposure section 38 irradiates with laser light the peripheral surface of the photosensitive member 37 having been uniformly charged by the charger 39, based on image data input from a personal computer (PC), which is a higher-level apparatus. As a result, an electrostatic latent image based on the image data is formed on the photosensitive member 37. The developing section 71 supplies toner to the peripheral surface of the photosensitive member 37 having the electrostatic latent image formed thereon, thereby to form a toner image based on the image data. The toner image is then transferred to the intermediate transfer belt 31 in the primary transfer. After completion of the primary transfer of the toner image to the intermediate transfer belt 31, the cleaner section cleans residual toner from the peripheral surface of the photosensitive member 37. As sequentially cleaned by the cleaner section, the peripheral surface of the photosensitive member 37 is forwarded toward the charger for subsequent charging and then subjected to charging.

The intermediate transfer belt 31 is a rotating endless belt. The intermediate transfer belt 31 is wound around a plurality of rollers (a drive roller 33, a driven roller 34, a backup roller 35, and a plurality of primary transfer rollers 36) and has a surface in contact with the respective peripheries of the photosensitive members 37. In addition, the intermediate transfer belt 31 is pressed against each photosensitive member 37 by the corresponding primary transfer roller 36 disposed opposite to the photosensitive member 37. Being pressed by the photosensitive members 37, the intermediate transfer belt 31 rotates as the plurality of rollers rotate. The drive roller 33 rotates with force of a drive source (a stepping motor, for example) to cause the intermediate transfer belt 31 to rotate. The driven roller 34, the backup roller 35, and the primary transfer rollers 36 are disposed freely rotatable and driven to rotate by rotation of the intermediate transfer belt 31 driven by the drive roller 33. The rollers 34, 35, and 36 support the intermediate transfer belt 31 in addition to being driven to rotate by active rotation of the drive roller 33 via the intermediate transfer belt 31.

The intermediate transfer belt 31 is driven by the drive roller 33 to rotate in the direction indicated by the arrow (counterclockwise) by passing between the respective photosensitive member 37 and primary transfer rollers 36. Each primary transfer roller 36 applies primary transfer bias (of the opposite polarity to the charging polarity of toner) to the intermediate transfer belt 31. As a result, the toner images formed on the respective photosensitive members 37 are sequentially transferred to be overlaid (primary transfer). In the present disclosure, the electric current to be applied can be 8 μA or higher.

The secondary transfer roller 32 applies secondary transfer bias, which is of the opposite polarity to the charging polarity of toner, to the paper P. As a result, the toner images transferred in the primary transfer to the intermediate transfer belt 31 are collectively transferred to the paper P passing between the secondary transfer roller 32 and the backup roller 35. Through the above operation, a color image, which is an unfixed toner image, is transferred to the paper P.

The fixing section 4 performs a fixing process so that the unfixed toner image transferred to the paper P by the image forming section 3 is fixed. The fixing section 4 has a heating roller 41 that is heated by a conductive heating element, and a pressure roller 42 that is disposed opposite to the heating roller 41 and pressed against the heating roller 41 to make contact at its peripheral surface with the peripheral surface of the heating roller 41.

The image transferred to the paper P from the secondary transfer roller 32 by the image forming section 3 is subjected to a fixing process in which the unfixed image is fixed by heat applied when the paper P passes between the heating roller 41 and the pressure roller 42. The paper P having gone through the fixing process is ejected to the paper ejecting section 5. The color printer 1 according to the present embodiment further includes one or more conveyance rollers 6 each at an appropriate location between the fixing section 4 and the paper ejecting section 5.

The paper ejecting section 5 is a recess formed on the top of the main body 1*a* of the color printer 1. The paper ejecting section 5 is provided with an exit tray 51 for receiving paper P ejected to the bottom of the recess.

Through the image forming operation described above, the color printer 1 forms an image on the paper P. Further, the image forming apparatus as described above includes, as the image bearing member, the positively chargeable electrophotographic photosensitive member according to the embodiment of the present disclosure. Such an image forming apparatus can thus form appropriate images without suffering from occurrence of transfer memory.

EXAMPLES

The following describes the present disclosure in greater detail by way of examples. It should be noted that the present disclosure is in no way limited by the examples.

[Preparation of Photosensitive Member]

[Preparation of Application Liquid for Charge Transport Layer]

Each composition listed in Table 1 below was prepared by adding, into a ball mill, a hole transport material (HTM), a binder resin having a viscosity-average molecular weight of 25000 according to the type and amount listed in Table 1, in addition to 800 parts by mass of tetrahydrofuran. Next, the respective compositions were each mixed for 10 hours to prepare application liquids CT1-1-CT1-8 and CT2-1-CT2-9 each for a charge transport layer. The binder resin added to the application liquids CT2-1-CT2-9 was a polyvinyl acetal resin.

TABLE 1

| | HTM | | Binder resin | |
|---|---|---|---|---|
| | Type | Parts by mass | Type | Parts by mass |
| CT1-1 | HT1 | 70 | R1/R2/R6 | 80/15/5 |
| CT1-2 | ↑ | ↑ | R3/R6 | ↑ |
| CT1-3 | ↑ | ↑ | R4/R6 | 95/5 |
| CT1-4 | ↑ | ↑ | R1/R7 | 50/50 |
| CT1-5 | ↑ | ↑ | R1/R8 | 50/50 |
| CT1-6 | HT2 | ↑ | R1/R2/R6 | 80/15/5 |
| CT1-7 | HT3 | ↑ | ↑ | ↑ |
| CT1-8 | HT4 | ↑ | ↑ | ↑ |
| CT2-1 | HT1 | ↑ | R1/R13 | 50/50 |
| CT2-2 | ↑ | ↑ | R5/R13 | 50/50 |
| CT2-3 | ↑ | ↑ | R1/R14 | 50/50 |
| CT2-4 | ↑ | ↑ | R7/R14 | 50/50 |
| CT2-5 | ↑ | ↑ | R9/R14 | 50/50 |
| CT2-6 | ↑ | ↑ | R15 | 100 |
| CT2-7 | ↑ | ↑ | R16 | 100 |
| CT2-8 | HT2 | ↑ | ↑ | ↑ |
| CT2-9 | HT3 | ↑ | ↑ | ↑ |

The respective codes used herein for the components denote the compounds represented by the following chemical formulas.

(Binder Resin)

The codes for the respective binder resins listed in Table 1 are shown below along with their chemical structures. In the present example, single resins (homopolymers) having the respective structures shown below were blended and used. A resin yielded by copolymerized monomers of the respective structures may be used because such a resin achieves the same effect.

R1

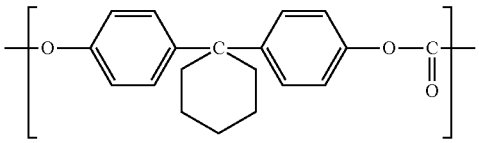

R2

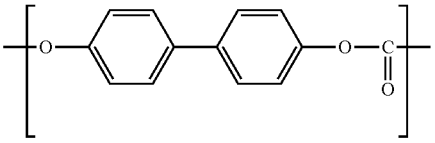

R3

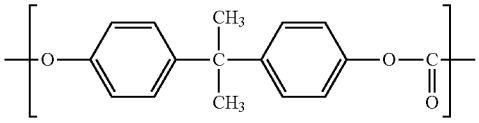

R4

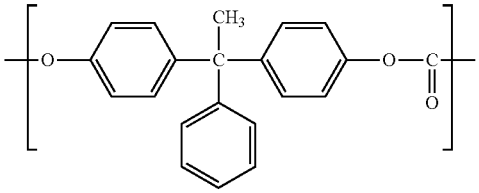

R5

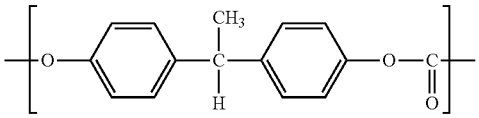

R6: Vylon RV-200 manufactured by Toyobo Co., Ltd

R7: PS-680 (polystyrene manufactured by PS Japan Cooperation)

R8

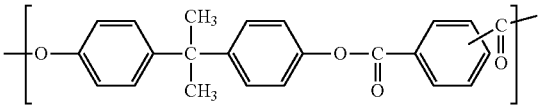

R9

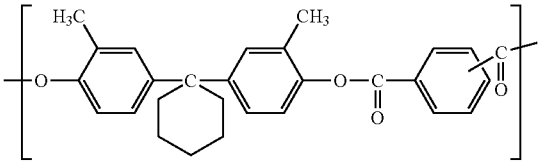

R10

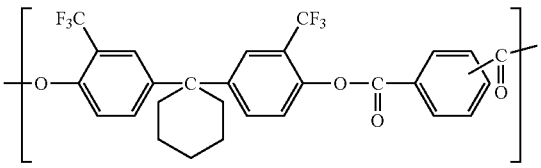

-continued

R11

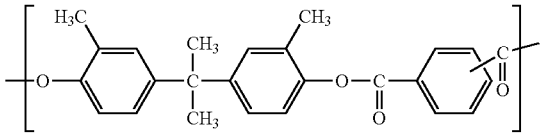

R12

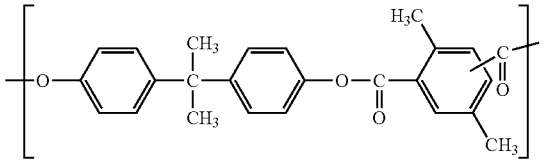

R13: Polyvinyl acetal resin (S-LEC KS-1 manufactured by Sekisui Chemical Co., Ltd.); degree of acetalization=about 74% by mol, molecular weight=about $2.7\times10^4$ R14: Polyvinyl acetal resin (S-LEC KS-5 manufactured by Sekisui Chemical Co., Ltd.); degree of acetalization=about 74% by mol, molecular weight=about $13\times10^4$ R15: Polyvinyl acetal resin (S-LEC BH-3 manufactured by Sekisui Chemical Co., Ltd.); degree of butyralization=about 65% by mol, molecular weight=about $11\times10^4$ R16: Polyvinyl acetal resin (S-LEC BM-1 manufactured by Sekisui Chemical Co., Ltd.); degree of butyralization=about 65% by mol, molecular weight=about $4.0\times10^4$ (Hole Transport Material (HTM))

HT1

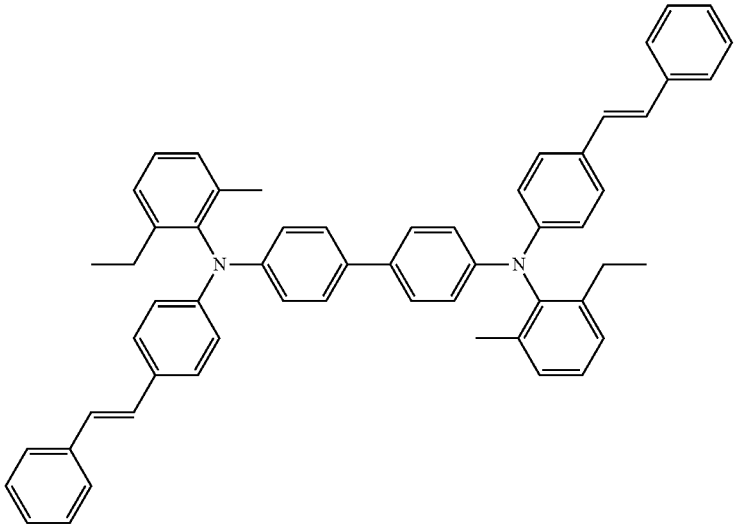

HT2

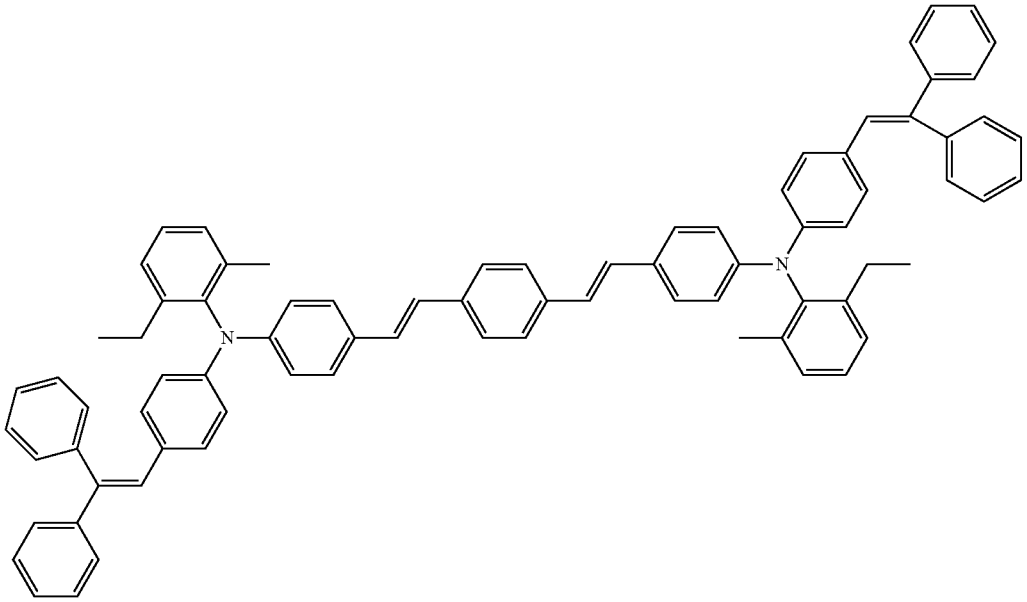

-continued
HT3
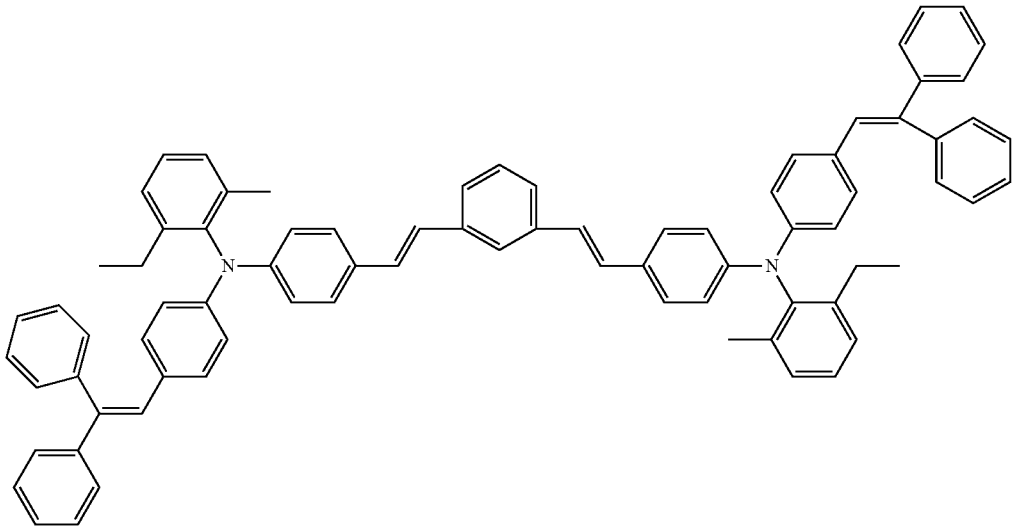
HT6
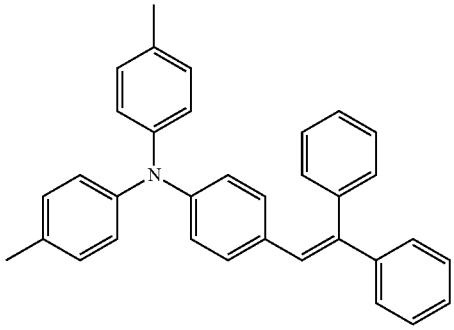
HT4
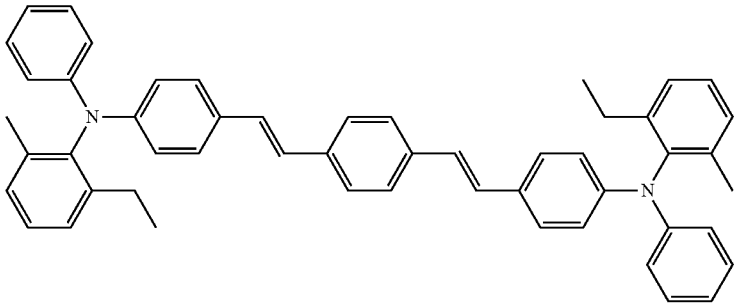
HT5
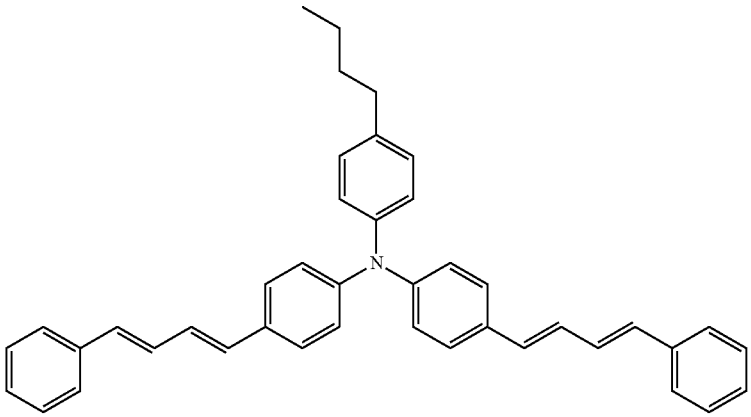

[Preparation of Application Liquid for Charge Generating-and-Transporting Layer]

Each composition listed in Table 2 below was prepared by adding, into a ball mill, a charge generating material (CGM), a hole transport material (HTM), an electron transport material (ETM), and a binder resin having a viscosity-average molecular weight of 40000 each according to the type and amount listed in Table 2, in addition to 1000 parts by mass of tetrahydrofuran. Then, the respective compositions were each mixed and dispersed for 50 hours to prepare the application liquids GT1-1-GT1-17 and GT2-1-GT2-6 each for a charge generating-and-transporting layer. The binder resin added to the application liquids GT2-1-GT2-6 was a polyvinyl acetal resin.

TABLE 2

| | CGM | | HTM | | ETM | | Binder resin | |
|---|---|---|---|---|---|---|---|---|
| | Type | Parts by mass | Type | Parts by mass | Type | Parts by mass | Type | Parts by mass |
| GT1-1 | CG1 | 3.0 | HT1 | 70 | ET1 | 50 | R1/R2 | 80/20 |
| GT1-2 | ↑ | ↑ | ↑ | ↑ | ↑ | ↑ | R1/R2/R5 | 50/20/30 |
| GT1-3 | ↑ | ↑ | ↑ | ↑ | ↑ | ↑ | R1/R10 | 50/50 |
| GT1-4 | ↑ | ↑ | ↑ | ↑ | ↑ | ↑ | R1/R11 | 50/50 |
| GT1-5 | ↑ | ↑ | ↑ | ↑ | ↑ | ↑ | R1/R12 | 50/50 |
| GT1-6 | ↑ | ↑ | ↑ | ↑ | ET2 | ↑ | R1/R2 | 80/20 |
| GT1-7 | ↑ | ↑ | ↑ | ↑ | ET3 | ↑ | ↑ | ↑ |
| GT1-8 | ↑ | ↑ | ↑ | ↑ | ET4 | ↑ | ↑ | ↑ |
| GT1-9 | ↑ | ↑ | ↑ | ↑ | ET5 | ↑ | ↑ | ↑ |
| GT1-10 | ↑ | ↑ | ↑ | ↑ | ET6 | ↑ | ↑ | ↑ |
| GT1-11 | ↑ | ↑ | ↑ | ↑ | ET7 | ↑ | ↑ | ↑ |
| GT1-12 | ↑ | ↑ | ↑ | ↑ | ET8 | ↑ | ↑ | ↑ |
| GT1-13 | ↑ | ↑ | ↑ | ↑ | ET9 | ↑ | ↑ | ↑ |
| GT1-14 | ↑ | ↑ | HT4 | ↑ | ET1 | ↑ | ↑ | ↑ |
| GT1-15 | ↑ | ↑ | HT5 | ↑ | ↑ | ↑ | ↑ | ↑ |
| GT1-16 | ↑ | ↑ | HT6 | ↑ | ↑ | ↑ | ↑ | ↑ |
| GT1-17 | CG2 | 3.0 | HT1 | ↑ | ↑ | ↑ | ↑ | ↑ |
| GT1-18 | CG3 | 3.5 | ↑ | ↑ | ↑ | ↑ | ↑ | ↑ |
| GT1-19 | CG4 | 5.0 | ↑ | ↑ | ↑ | ↑ | ↑ | ↑ |
| GT2-1 | CG1 | 3.0 | HT1 | ↑ | ↑ | ↑ | R1/R13 | 50/50 |
| GT2-2 | ↑ | ↑ | ↑ | ↑ | ↑ | ↑ | R5/R2/R13 | 40/10/50 |
| GT2-3 | ↑ | ↑ | ↑ | ↑ | ↑ | ↑ | R1/R14 | 50/50 |
| GT2-4 | ↑ | ↑ | ↑ | ↑ | ↑ | ↑ | R15 | 100 |
| GT2-5 | ↑ | ↑ | ↑ | ↑ | ↑ | ↑ | R16 | 100 |
| GT2-6 | ↑ | ↑ | HT4 | ↑ | ET3 | 20 | ↑ | ↑ |

Each codes used for the charge generating material (CGM) and the electron transport material (ETM) denote the following. The codes used for the binder resin and hole transport material (HTM) are the same as those used above in the description of the preparation of the application liquids for the charge transport layer.

(Charge Generating Material (CGM))

CG1: a titanyl phthalocyanine crystal satisfying both of the following: (A) in CuKα characteristic X-ray diffraction, a maximum peak is observed at a Bragg angle of 2θ±0.2°=27.2° and no peak is observed at a Bragg angle of 26.2°; and (B) in differential scanning calorimetry, a single peak is observed within a range of 270° C. to 400° C. except for the peak caused by vaporization of absorbed water.

CG2: a titanyl phthalocyanine crystal satisfying both of the following: (A) in CuKα characteristic X-ray diffraction, a maximum peak is observed at a Bragg angle of 2θ±0.2°=27.2° and no peak is observed at a Bragg angle of 26.2°; and (C) in differential scanning calorimetry, no peak is observed within a range of 50° C. to 400° C. except for the peak caused by vaporization of absorbed water.

CG3: a titanyl phthalocyanine crystal satisfying both of the following: (A) in CuKα characteristic X-ray diffraction, a maximum peak is observed at a Bragg angle of 2θ±0.2°=27.2° and no peak is observed at a Bragg angle of 26.2°; and (D) in differential scanning calorimetry, a single peak is observed within a range of 50° C. to 270° C. except for the peak caused by vaporization of absorbed water.

(Electron Transport Material (ETM))

ET1

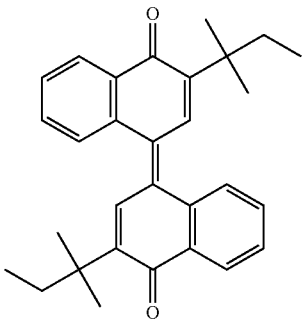

-continued

ET2

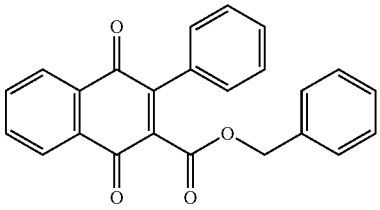

ET3

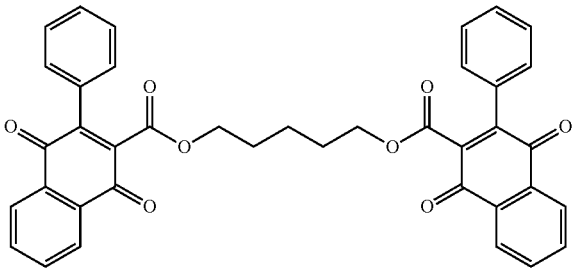

ET4

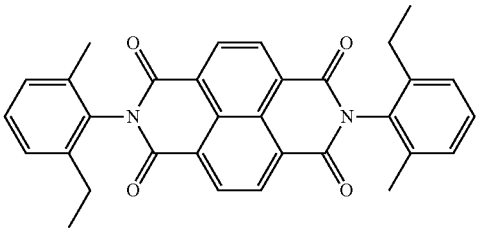

ET5

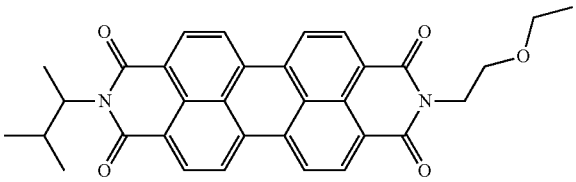

ET6

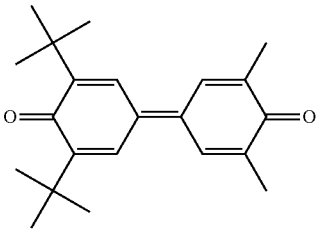

-continued

ET7

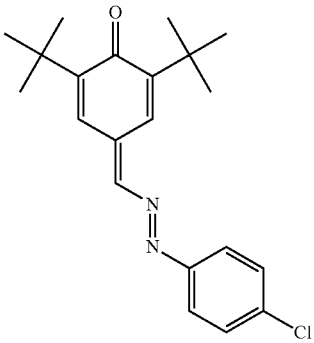

ET8

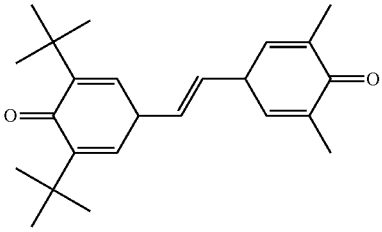

ET9

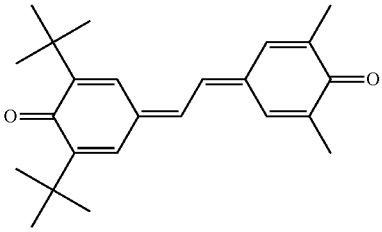

Example 1-49 and Comparative Example 1-7

The application liquids of the types listed in Tables 3-5 were applied by dip coating. By the application of the respective application liquids, one or more of the first charge transport layer, the second charge transport layer, and the charge generating-and-transporting layer were formed on a conductive substrate each to the thickness listed in Tables 3-5. As a result, two- or three-layer positively chargeable electrophotographic photosensitive members of Examples 1-49 and Comparative Examples 1-7 were obtained. The positively chargeable electrophotographic photosensitive members thus obtained were evaluated for sensitivity by the following method. Tables 3-5 show evaluation results of the sensitivity.

[Method for Evaluating Sensitivity]

A drum sensitivity test device manufactured by Gentec Inc. was used to charge the surface of the photosensitive member to the potential of 800 V. Then, the surface of the photosensitive member was exposed to monochromatic light (exposure wavelength: 780 nm and light intensity: 0.15 $\mu J/cm^2$) which was extracted from white light emitted by a halogen lamp with the use of a bandpass filter. After a lapse of 0.1 second from the start of light exposure, the surface potential was measured as the sensitivity and evaluated according to the following criteria.

Good: Surface potential of less than 250 V

Poor: Surface potential of 250 V or higher

TABLE 3

| | First charge transport layer | Thickness (μm) | Second charge transport layer | Thickness (μm) | Charge generating-and-transporting layer | Thickness (μm) | Sensitivity (V) | Judgment |
|---|---|---|---|---|---|---|---|---|
| Example 1 | CT1-1 | 20 | — | — | GT2-1 | 5 | 156 | Good |
| Example 2 | ↑ | ↑ | — | — | GT2-2 | ↑ | 155 | Good |
| Example 3 | ↑ | ↑ | — | — | GT2-3 | ↑ | 161 | Good |
| Example 4 | ↑ | ↑ | — | — | GT2-4 | ↑ | 149 | Good |
| Example 5 | ↑ | ↑ | — | — | GT2-5 | ↑ | 153 | Good |
| Example 6 | ↑ | ↑ | — | — | GT2-6 | ↑ | 162 | Good |
| Example 7 | CT1-2 | ↑ | — | — | ↑ | ↑ | 157 | Good |
| Example 8 | CT1-3 | ↑ | — | — | ↑ | ↑ | 153 | Good |
| Example 9 | CT1-4 | ↑ | — | — | ↑ | ↑ | 154 | Good |
| Example 10 | CT1-5 | ↑ | — | — | ↑ | ↑ | 152 | Good |
| Example 11 | CT1-6 | ↑ | — | — | ↑ | ↑ | 153 | Good |
| Example 12 | CT1-7 | ↑ | — | — | ↑ | ↑ | 159 | Good |
| Example 13 | CT1-8 | ↑ | — | — | ↑ | ↑ | 161 | Good |
| Example 14 | CT2-1 | ↑ | — | — | GT1-1 | ↑ | 171 | Good |
| Example 15 | CT2-2 | ↑ | — | — | ↑ | ↑ | 168 | Good |
| Example 16 | CT2-3 | ↑ | — | — | ↑ | ↑ | 174 | Good |
| Example 17 | CT2-4 | ↑ | — | — | ↑ | ↑ | 174 | Good |
| Example 18 | CT2-5 | ↑ | — | — | ↑ | ↑ | 172 | Good |
| Example 19 | CT2-6 | ↑ | — | — | ↑ | ↑ | 179 | Good |
| Example 20 | CT2-7 | ↑ | — | — | ↑ | ↑ | 178 | Good |
| Example 21 | CT2-8 | ↑ | — | — | ↑ | ↑ | 182 | Good |
| Example 22 | CT2-9 | ↑ | — | — | ↑ | ↑ | 177 | Good |
| Example 23 | CT2-1 | ↑ | — | — | GT1-2 | ↑ | 172 | Good |
| Example 24 | ↑ | ↑ | — | — | GT1-3 | ↑ | 170 | Good |
| Example 25 | ↑ | ↑ | — | — | GT1-4 | ↑ | 171 | Good |
| Example 26 | ↑ | ↑ | — | — | GT1-5 | ↑ | 172 | Good |
| Example 27 | ↑ | ↑ | — | — | GT1-6 | ↑ | 178 | Good |
| Example 28 | ↑ | ↑ | — | — | GT1-7 | ↑ | 175 | Good |
| Example 29 | ↑ | ↑ | — | — | GT1-8 | ↑ | 171 | Good |
| Example 30 | ↑ | ↑ | — | — | GT1-9 | ↑ | 173 | Good |
| Example 31 | ↑ | ↑ | — | — | GT1-10 | ↑ | 169 | Good |
| Example 32 | ↑ | ↑ | — | — | GT1-11 | ↑ | 172 | Good |
| Example 33 | ↑ | ↑ | — | — | GT1-12 | ↑ | 170 | Good |
| Example 34 | ↑ | ↑ | — | — | GT1-13 | ↑ | 170 | Good |
| Example 35 | ↑ | ↑ | — | — | GT1-14 | ↑ | 176 | Good |
| Example 36 | ↑ | ↑ | — | — | GT1-15 | ↑ | 174 | Good |
| Example 37 | ↑ | ↑ | — | — | GT1-16 | ↑ | 179 | Good |
| Example 38 | ↑ | ↑ | — | — | GT1-17 | ↑ | 182 | Good |
| Example 39 | ↑ | ↑ | — | — | GT1-18 | ↑ | 189 | Good |
| Example 40 | ↑ | ↑ | — | — | GT1-19 | ↑ | 212 | Good |

TABLE 4

| | First charge transport layer | Thickness (μm) | Second charge transport layer | Thickness (μm) | Charge generating-and-transporting layer | Thickness (μm) | Sensitivity (V) | Judgment |
|---|---|---|---|---|---|---|---|---|
| Example 41 | CT1-1 | 20 | CT2-1 | 2 | GT1-1 | 5 | 183 | Good |
| Example 42 | ↑ | ↑ | CT2-2 | ↑ | ↑ | ↑ | 182 | Good |
| Example 43 | ↑ | ↑ | CT2-3 | ↑ | ↑ | ↑ | 184 | Good |
| Example 44 | ↑ | ↑ | CT2-4 | ↑ | ↑ | ↑ | 182 | Good |
| Example 45 | ↑ | ↑ | CT2-5 | ↑ | ↑ | ↑ | 181 | Good |
| Example 46 | ↑ | ↑ | CT2-6 | ↑ | ↑ | ↑ | 189 | Good |
| Example 47 | CT1-2 | ↑ | CT2-7 | ↑ | ↑ | ↑ | 192 | Good |
| Example 48 | CT1-3 | ↑ | CT2-8 | ↑ | ↑ | ↑ | 188 | Good |
| Example 49 | CT1-4 | ↑ | CT2-9 | ↑ | ↑ | ↑ | 187 | Good |

TABLE 5

| | First charge transport layer | Thickness (μm) | Second charge transport layer | Thickness (μm) | Charge generating and transporting layer | Thickness (μm) | Sensitivity (V) | Judgment |
|---|---|---|---|---|---|---|---|---|
| Comparative example 1 | — | — | — | — | GT1-1 | 25 | 300 | Poor |
| Comparative example 2 | — | — | — | — | GT1-15 | ↑ | 321 | Poor |

TABLE 5-continued

| | First charge transport layer | Thickness (μm) | Second charge transport layer | Thickness (μm) | Charge generating and transporting layer | Thickness (μm) | Sensitivity (V) | Judgment |
|---|---|---|---|---|---|---|---|---|
| Comparative example 3 | — | — | — | — | GT1-17 | ↑ | 412 | Poor |
| Comparative example 4 | CT1-1 | 20 | — | — | GT1-1 | 5 | Non-uniform layer formation | Poor |
| Comparative example 5 | CT1-4 | ↑ | — | — | ↑ | ↑ | | Poor |
| Comparative example 6 | CT1-1 | 18 | CT1-1 | 2 | GT1-1 | ↑ | | Poor |
| Comparative example 7 | CT2-1 | ↑ | ↑ | ↑ | ↑ | ↑ | | Poor |

Table 3 shows the evaluation results on the two-layer photosensitive members according to the first embodiment of the present disclosure. Table 4 shows the evaluation results on the three-layer photosensitive members according to the first embodiment of the present disclosure. Table 5 shows the evaluation results on comparative examples, which are single-layer electrophotographic photosensitive members, and two-layer photosensitive members not containing a polyacetal resin as the binder resin. As indicated by Comparative Examples 4-7 shown in Table 5, favorable two-layer photosensitive members were failed to be prepared with any multi-layered photosensitive layer not containing a polyvinyl acetal resin as the binder resin. In contrast, each multi-layered photosensitive member according to the present disclosure contains a polyvinyl acetal resin in one layer thereof and thus compares favorably to the single-layer photosensitive members of Comparative Examples 1-3 by exhibiting higher sensitivity.

What is claimed is:

1. A positively chargeable electrophotographic photosensitive member comprising a photosensitive layer, wherein the photosensitive layer includes, layered in the stated order, a charge transport layer at least containing a hole transport material and a binder resin, and a charge generating-and-transporting layer at least containing a charge generating material, an electron transport material, a hole transport material, and a binder resin all in the charge generating-and-transporting layer, the charge generating-and-transporting layer contains as the electron transport material one or more compounds represented by chemical formulas ET1, ET2, ET3, ET4, ET5, ET7, ET8, and ET9 below,

ET1

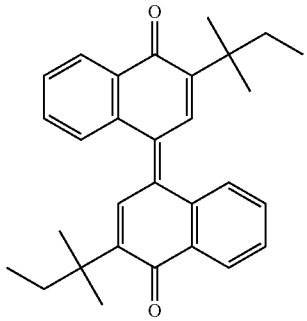

ET2

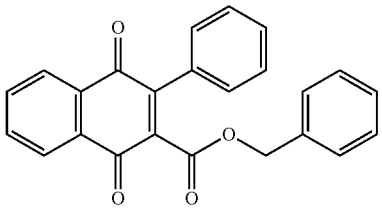

ET3

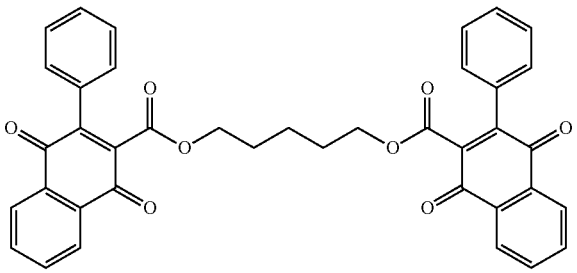

ET4

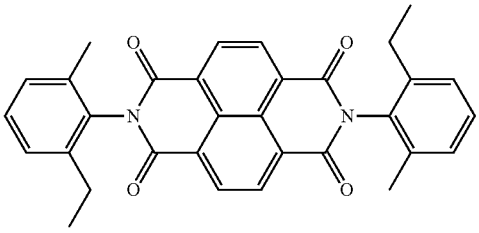

-continued

ET5

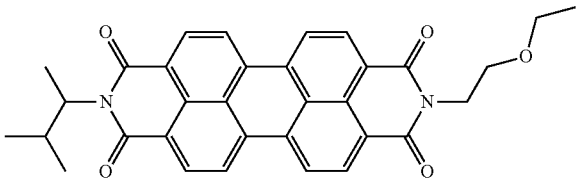

ET7

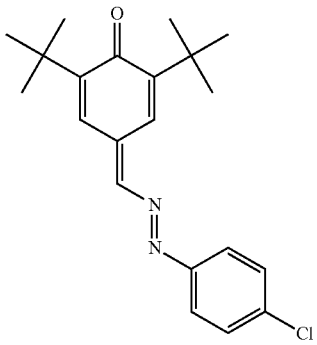

ET8

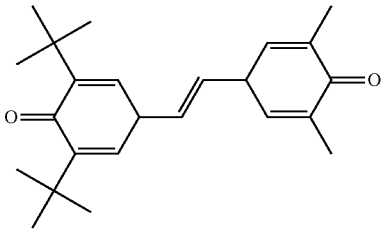

ET9

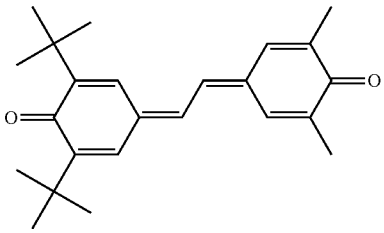

the binder resin contained in the charge transport layer is different from the binder resin contained in the charge generating-and-transporting layer, and from among the binder resins contained in the charge transport layer and the charge generating-and-transporting layer, one of the binder resins contains a polyvinyl acetal resin and the other of the binder resins contains no polyvinyl acetal resin.

2. A positively chargeable electrophotographic photosensitive member according to claim 1, wherein the binder resin contained in the charge transport layer contains the polyvinyl acetal resin, and the binder resin contained in the charge generating-and-transporting layer contains no polyvinyl acetal resin.

3. A positively chargeable electrophotographic photosensitive member according to claim 1, wherein a content of the polyvinyl acetal resin in the binder resin contained in the charge transport layer or in the binder resin contained the charge generating-and-transporting layer in the charge generating-and-transporting layer is from 50% by mass to 100% by mass with respect to a total mass of the binder resin that contains the polyvinyl acetal resin.

4. A positively chargeable electrophotographic photosensitive member according to claim 1, wherein the charge transport layer has a multi-layered structure that includes, layered in the stated order, a first charge transport layer at least containing a hole transport material and a binder resin, and a second charge transport layer at least containing a hole transport material and a binder resin, the second charge transport layer is disposed between the first charge transport layer and the charge generating-and-transporting layer, the binder resin contained in the second charge transport layer contains a polyvinyl acetal resin, and neither of the binder resins contained in the first charge transport layer nor the binder resin contained in the charge generating-and-transporting layer contains a polyvinyl acetal resin.

5. A positively chargeable electrophotographic photosensitive member according to claim 4, wherein a content of the polyvinyl acetal resin in the binder resin contained in the second charge transport layer is from 50% by mass to 100% by mass with respect to a total mass of the binder resin that contains the polyvinyl acetal resin.

6. A positively chargeable electrophotographic photosensitive member according to claim 4, wherein the second charge transport layer is thinner than the first charge transport layer.

7. An image forming apparatus comprising:

an image bearing member;

a charger configured to charge a surface of the image bearing member;

an exposure section configured to expose the charged surface of the image bearing member to light thereby to form an electrostatic latent image thereon;

a developing section configured to develop the electrostatic latent image into a toner image; and a transfer section configured to transfer the toner image from the image bearing member to a transfer target, wherein the image bearing member is a positively chargeable electrophotographic photosensitive member according to claim 1.

8. A positively chargeable electrophotographic photosensitive member according to claim 1, wherein the charge transport layer contains as the hole transport material one or more compounds represented by chemical formulas HT1, HT2, and HT3 below, HT1
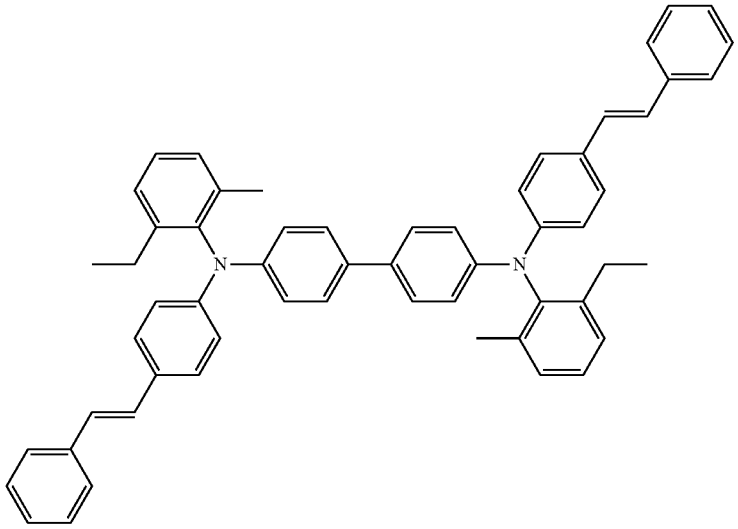
HT2
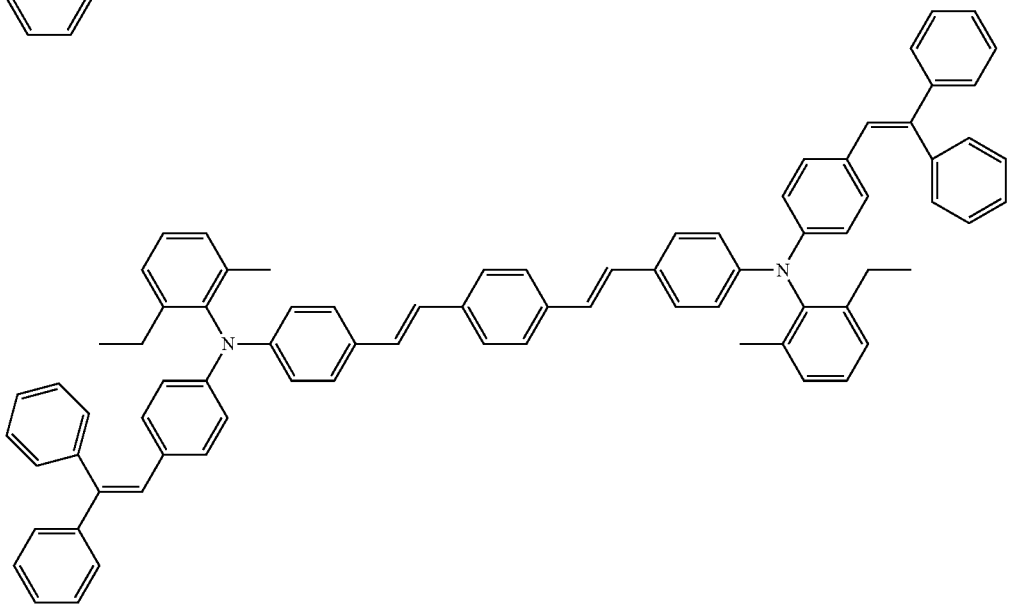
HT3
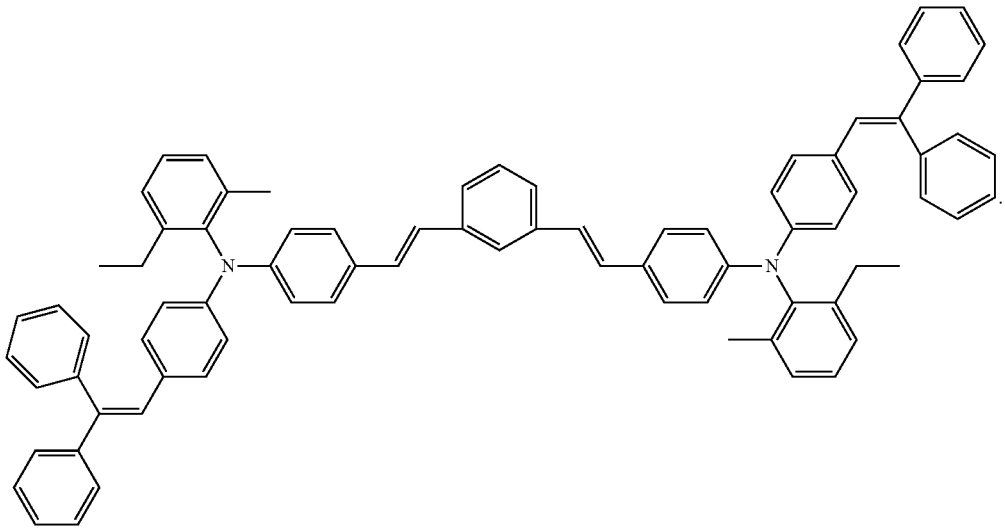

9. A positively chargeable electrophotographic photosensitive member according to claim 1, wherein
the charge generating-and-transporting layer contains as the hole transport material one or more compounds represented by chemical formulas HT1, HT2, HT3, and HT5 below,
HT1
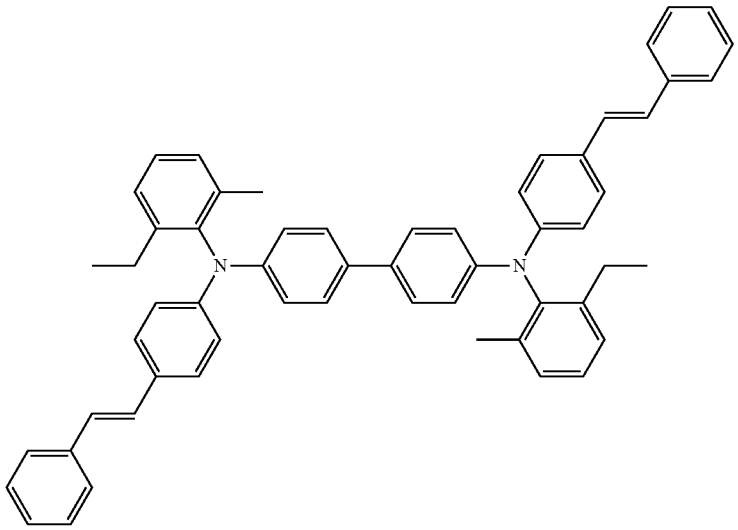
HT2
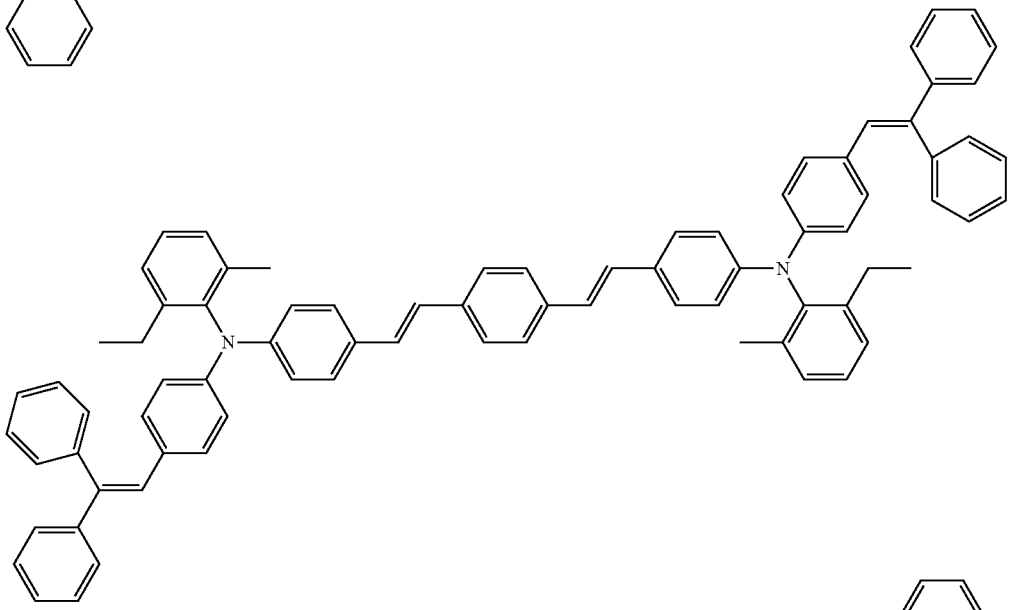
HT3
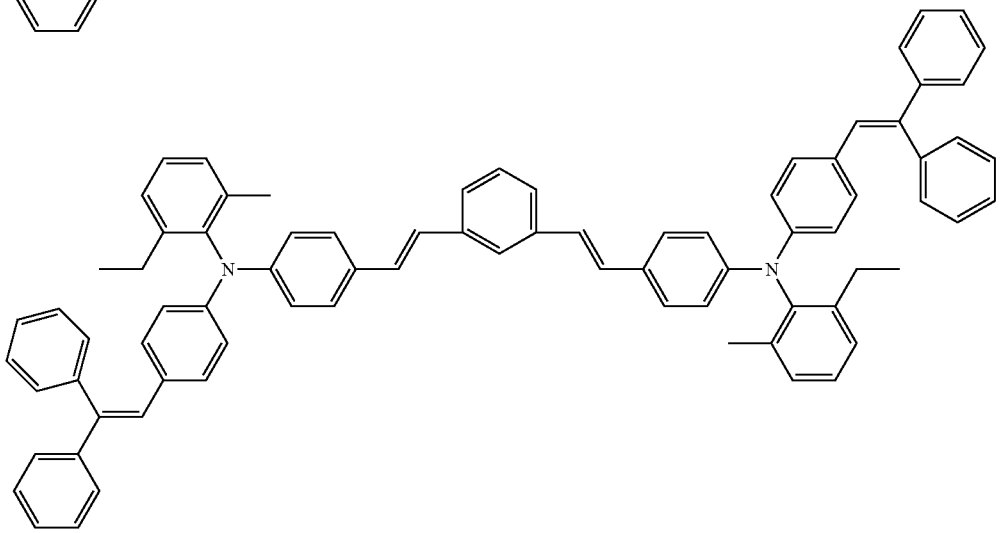

-continued

HT5

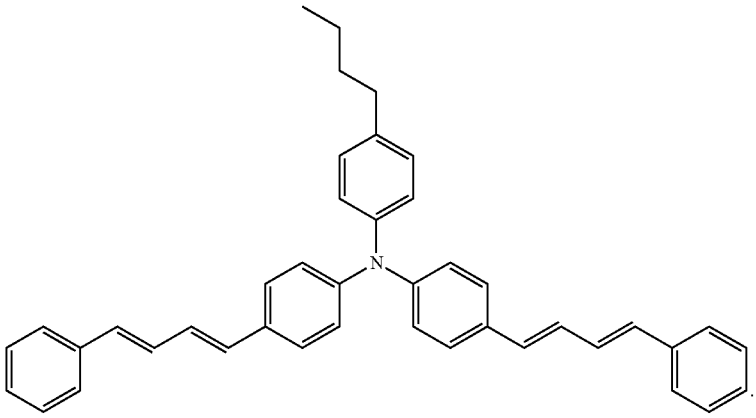

10. A positively chargeable electrophotographic photosensitive member according to claim 3, wherein the binder resin contained in the charge transport layer contains the polyvinyl acetal resin and a resin other than the polyvinyl acetal resin, and a content of the polyvinyl acetal resin in the binder resin contained in the charge transport layer is from 50% by mass and less than 100% by mass with respect to a total mass of the binder resin contained in the charge transport layer.

11. A positively chargeable electrophotographic photosensitive member according to claim 3, wherein the binder resin contained in the charge generating-and-transporting layer contains the polyvinyl acetal resin and a resin other than the polyvinyl acetal resin, and a content of the polyvinyl acetal resin in the binder resin contained in the charge generating-and-transporting layer is from 50% by mass and less than 100% by mass with respect to a total mass of the binder resin contained in the charge generating-and-transporting layer.

* * * * *